US008607860B2

(12) United States Patent
Avant et al.

(10) Patent No.: US 8,607,860 B2
(45) Date of Patent: Dec. 17, 2013

(54) FLEXIBLE COLLET ANCHOR ASSEMBLY WITH COMPRESSIVE LOAD TRANSFER FEATURE

(75) Inventors: Marcus A. Avant, Kingwood, TX (US); Douglas J. Murray, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 358 days.

(21) Appl. No.: 12/980,626

(22) Filed: Dec. 29, 2010

(65) Prior Publication Data

US 2012/0168148 A1 Jul. 5, 2012

(51) Int. Cl.
*E21B 23/02* (2006.01)

(52) U.S. Cl.
USPC ..... 166/208; 166/117.6; 166/125; 166/382

(58) Field of Classification Search
USPC ..... 166/208, 382, 242.7, 117.6, 125
See application file for complete search history.

(56) References Cited

U.S. PATENT DOCUMENTS 2,673,614 A * 3/1954 Miller ..... 166/214
2,976,931 A * 3/1961 Daffin ..... 166/125
3,102,593 A * 9/1963 Sizer ..... 166/125
3,126,059 A * 3/1964 Fredd ..... 166/125
3,494,417 A * 2/1970 Fredd ..... 166/73
3,507,329 A * 4/1970 Stone, Jr. ..... 166/214
3,698,477 A * 10/1972 Radig et al. ..... 166/214
3,802,505 A * 4/1974 Majors, Jr. ..... 166/136
3,856,081 A * 12/1974 Canalizo ..... 166/123
4,139,059 A * 2/1979 Carmichael ..... 166/208
4,164,977 A * 8/1979 Arendt et al. ..... 166/125
4,289,202 A * 9/1981 Henderson ..... 166/212
4,295,528 A * 10/1981 Carmody ..... 166/382
4,315,544 A * 2/1982 Monauni et al. ..... 166/214
4,372,393 A * 2/1983 Baker ..... 166/382
4,433,726 A 2/1984 Preston, Jr. et al.
4,437,522 A * 3/1984 Krause et al. ..... 166/382
4,488,596 A * 12/1984 Akkerman ..... 166/217
4,510,995 A 4/1985 Krause, Jr. et al.
4,513,817 A * 4/1985 Weinberg ..... 166/138
4,583,591 A 4/1986 Krause, Jr. et al.
4,840,229 A * 6/1989 Proctor et al. ..... 166/381
4,844,159 A * 7/1989 Airey et al. ..... 166/214
4,928,768 A 5/1990 Peterson
5,197,546 A 3/1993 Murray
5,398,754 A 3/1995 Dinhoble
5,409,059 A * 4/1995 McHardy ..... 166/208
5,433,275 A 7/1995 Melenyzer et al.
5,538,082 A * 7/1996 Zwart ..... 166/382
5,924,491 A 7/1999 Jordan, Jr. et al.
5,988,287 A 11/1999 Jordan, Jr. et al.
6,464,006 B2 10/2002 Womble
7,210,534 B2 * 5/2007 Hayter et ..... 166/386
7,552,779 B2 * 6/2009 Murray ..... 166/386

(Continued)

*Primary Examiner* — Jennifer H Gay
(74) *Attorney, Agent, or Firm* — Steve Rosenblatt

(57) ABSTRACT

A collet assembly has a housing and the collets disposed on flexible fingers connected to the housing at their opposed ends. A surrounding landing sleeve stops the assembly so that collets are aligned with a recess in a landing collar that is part of a surrounding tubing string. Once set the landing sleeve transmits compressive loads so that compressive stress essentially bypasses the finger structure supporting the collets. The fingers are initially tapered toward a longitudinal axis so that when internally supported they assume an aligned orientation to the housing axis to allow greater tensile loading and to provide a retraction force when the housing is to be removed after the collet support is removed.

23 Claims, 1 Drawing Sheet

(56) References Cited

U.S. PATENT DOCUMENTS

| | | | | |
|---|---|---|---|---|
| 7,617,880 | B2 | 11/2009 | Loughlin | |
| 2004/0026090 | A1 | 2/2004 | McGlothen et al. | |
| 2005/0199399 | A1 | 9/2005 | Hayter et al. | |
| 2010/0108325 | A1 | 5/2010 | Solland | |
| 2010/0206566 | A1* | 8/2010 | Adam et al. | 166/285 |
| 2011/0168408 | A1* | 7/2011 | Watson | 166/382 |
| 2012/0012338 | A1* | 1/2012 | Blanton et al. | 166/382 |
| 2012/0168148 | A1* | 7/2012 | Avant et al. | 166/209 |

* cited by examiner

FLEXIBLE COLLET ANCHOR ASSEMBLY WITH COMPRESSIVE LOAD TRANSFER FEATURE

FIELD OF THE INVENTION

The field of the invention is collet type anchors for subterranean use and more particularly the collets that are located on flexible fingers for engaging a profile in a tubular string and providing additional features to retain large loads that limit stress to the fingers that support the collet.

BACKGROUND OF THE INVENTION

Locking devices for support of tools such as plugs in a tubular string have been used in the past. These designs use a recess profile in the string as the location for the engagement of the lock device that supports the tool such as a plug. Typically the string has a no go shoulder so that when the assembly is introduced into the string and hits a travel limit there are an assembly of dogs that are selectively extendable through windows in the housing. These dogs are then extended radially by a sleeve within the tool that has an exterior ramp that engages the dogs. As the sleeve advances the dogs are cammed out and the sleeve has a larger diameter behind the camming ramp that then serves to keep the dogs extended into a profile in a landing collar that is part of the tubular string. The seal of a plug that is installed in this manner lands in a seal bore and is subjected to tensile or compressive stresses depending on the direction of differential pressure. One of the issues with this design in tensile loading with pressure differential coming from above is that the stress is transmitted through the window structure and the thin segments of the housing that defines the region between the windows so that the stress on the housing can get to the dogs that are extended into the recess of the landing nipple in the tubing string. Some examples of this design are U.S. Pat. Nos. 4,510,995 and 4,583,591.

Another design that can anchor to a surrounding structure is a collet system where the collets are a thick wall segment in the middle of strips made from machined slots in a tubular housing to lend flexibility to the collets for running in and setting when aligned with a groove of a tool downhole. This collet design is generally used in light duty applications such as shifting a sleeve as opposed to supporting an assembly subjected to high stresses from differential pressure such as a plug in a tubular string. These types of tools have generally been run inside other tools to operate an internal component in an existing downhole tool followed by removal when that task is accomplished.

Yet another type of intelligent collet is described in U.S. Pat. No. 6,464,006 that allows selecting landing or bypassing a support platform to properly position a multi-position crossover tool in a gravel packing context.

The present invention seeks to use the flexible finger style collet as an anchor device to a tubular string when supporting a tool that will undergo large loads such as 30,000 pounds of force or more. In adapting such as design for high load application the present invention includes features that allow the ability of large compressive loads to essentially bypass the weaker supporting finger structure so that load goes to the collet in the surrounding groove directly through the provision of an external sleeve that doubles in duty as the locating sleeve for the anchor assembly. The fingers are provided with an exterior inward taper so that in the set condition they are axially aligned with the surrounding tubular access rather than being bent outwardly when in the set position. Such an initial orientation also helps to retract the collets when support is removed for retrieval because of their tendency to retract to pull the collet out of the surrounding profile recess when support is removed. These and other features of the present invention will be more apparent to those skilled in the art from a review of the detailed description of the preferred embodiment and the associated drawings while recognizing that the full scope of the invention is to be found in the appended claims.

SUMMARY OF THE INVENTION

A collet assembly has a housing and the collets disposed on flexible fingers connected to the housing at their opposed ends. A surrounding landing sleeve stops the assembly so that collets are aligned with a recess in a landing collar that is part of a surrounding tubing string. Once set the landing sleeve transmits compressive loads so that compressive stress essentially bypasses the finger structure supporting the collets. The fingers are initially tapered toward a longitudinal axis so that when internally supported they assume an aligned orientation to the housing axis to allow greater tensile loading and to provide a retraction force when the housing is to be removed after the collet support is removed.

DETAILED DESCRIPTION OF THE PREFERRED EMBODIMENT

Figure 1:
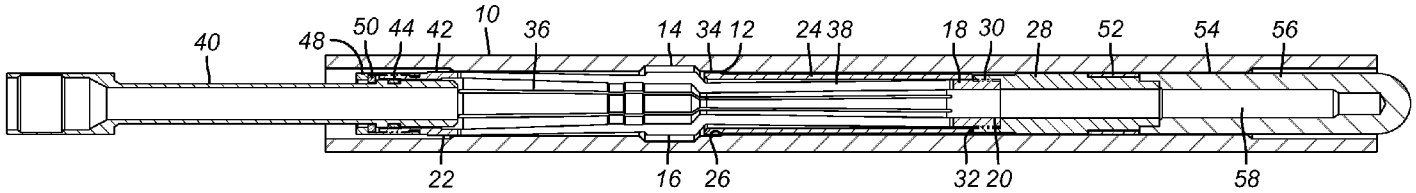
FIG. 1 is a section view of the collet assembly in the run in position.
Figure 2:
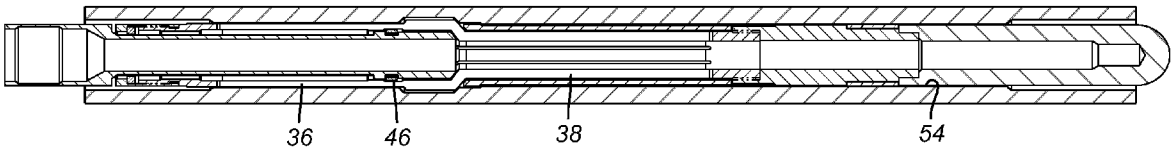
FIG. 2 is the view of FIG. 1 with the collet assembly in the set position.

Referring to FIG. 1 a tubular string or a landing collar in a tubular string is represented as 10. It has a landing shoulder 12 and recess 14 a little above the shoulder 12. Recess 14 can be a circumferential groove or a series of adjacent groove segments that accept the collet heads 16 as shown in the set position of FIG. 2. Housing 18 has a lower end 20 and an upper end 22. The lower end 20 has a smaller outer dimension than the upper end 22 because a landing sleeve 24 with a generally radial surface 26 is disposed over the housing 18 between the collet heads 16 and the lower end 20. Lower end 20 supports a sleeve 28 at thread 30. Sleeve 28 defines a support surface 32 for landing sleeve 24. The upper end 34 of the landing sleeve 24 is designed to contact the collet heads 16 when they are extended into recess 14. This contact can occur when the collet heads 16 are initially extended into the recess 14, which lifts sleeve 24 off the shoulder 12, or it can happen after a differential in the downhole direction puts a tensile load on the fingers 38 which moves the collet heads 16 in the recess 14 to initially achieve the contact with the sleeve 24.

The collet heads 16 are supported by upper fingers 36 and lower fingers 38. Sleeve 24 surrounds lower fingers 38. On their exterior, the fingers 36 and 38 taper larger going away from the collet heads 16 and in opposed directions. The same taper is found on the inside of the fingers 36 and 38. A actuator 40, when advanced from the FIG. 1 run in position to the set position of FIG. 2 will push fingers 36 radially outwardly until the orientation of the fingers 36 is essentially parallel to the axis of the housing 18 with the collet heads 16 in recess 14. The actuator 40 stops at travel stop 42 which is a taper at the lower end of the collet heads 16. The set position is locked by a snap ring 44 carried by actuator 40 that snaps out into groove 46 on fingers 36 in the set position of FIG. 2. A retainer sleeve 48 holds a retaining ring 50 to secure the actuator 40 and the housing 18 against separation for run in or retrieval.

Sleeve 28 supports a seal 52 that preferably lands in a polished bore 54 of the landing collar 10. An end cap 56 closes off the passage 58 to allow the seal to function as a barrier in the string 10. Those skilled in the art will appreciate that the illustrated anchor can support a variety of downhole tools and the type of tool illustrated is by no means limiting on the application of the disclosed anchor assembly of the present invention.

Figure 3:
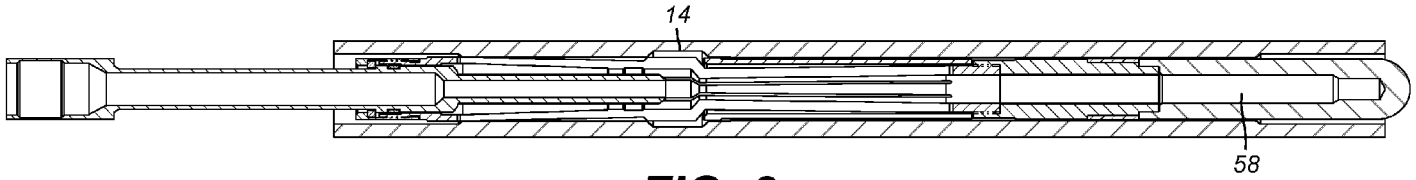
FIG. 3 is identical to FIG. 1 except for the additional length on the actuator and shown in the run in position.
Figure 4:
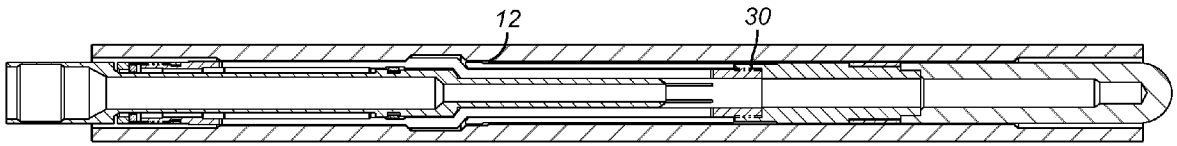
FIG. 4 is the view of FIG. 3 shown in the set position where the additional length of the actuator goes past the collet heads to support the lower end of the fingers if loaded in compression.

Anchors such as the described design can carry 30, 000 pounds of load or more and have not been known to be applied to anchors engaging a recess in a tubular string in the past. The finger type collet design has been employed in sleeve shifting or other applications where the tool is deployed to move a part downhole and then removed to the surface. Thus the application of finger type collets in anchor service to a tubular string and more particularly in supporting a plug that will experience large differential pressure and associated stress have not been tried previously. The provision of a sleeve 24 around the fingers 38 that serves not only as a locating sleeve but also under compressive loading as a force transfer mechanism around the fingers 38 and directly to the collet heads 16 is part of what allows the application of the illustrated design as an anchor in a surrounding tubular that is highly stressed in either or both tensile and compressive stresses. Compressive loading passes from the lower end area 20 right into sleeve 24 through support surface 32 of sleeve 28 and right into collet heads 16 through the top end 34 of the landing sleeve 24. As an alternative, the actuator 40 can be made longer as shown in FIGS. 3 and 4 so that in the set position of FIG. 4 the fingers 38 are narrowly internally guided by the actuator 40 and can be externally guided either with sleeve 24 or, optionally, sleeve 24 can be omitted and the surrounding tubular can also lend support against buckling under compressive loading. In the preferred embodiment of FIGS. 3 and 4 both the sleeve 24 and the longer actuator would be used in tandem. The downside of using both is that the passage through the actuator would get smaller; however, in applications where an end cap 56 is supported by the assembly 10 the diameter of passage 58 is not relevant as there is no need for flow or access through that passage. Leaving out the sleeve 24 will subject the fingers 38 to compressive loading but in some applications where the compressive loads are within acceptable limits and the guiding against the surrounding tubular in the set position of FIG. 4 is close enough, the fingers 38 can be up to transmitting the compressive load without plastic deformation.

The diverging tapered orientation of the fingers 36 and 38 on run in allows such fingers to be deflected to a parallel or near parallel orientation with the axis of the housing 18 thus providing several advantages over designs that start out parallel and have to be pushed out for engaging collet heads to a surrounding recess. One result is that the tensile stress capability in the fingers 36 is higher because they are not slant oriented when loaded. Prior finger designs pushed the fingers to a slant out orientation for the set position and the present invention provides an initial inward slant toward the collet heads 16 by the fingers 36 so that in the FIG. 2 set position they are closer to axial alignment with the axis of the housing 18. When the actuator 40 is retracted making the snap ring 44 jump out of groove 46 the potential energy built into the fingers 36 when put in their set position now pushes them back to their original position to help better retract the collet heads 16 from the recess 14.

While the presence of sleeve 24 reduces the internal dimension near lower end 20 in the case of a tubular plug this makes no difference as the passage in the string is to be blocked in any event. However, the sleeve 24 can serve as a stress conduit in compression transferring load around the fingers 38 to give the assembly a robust design feature that helps it take high loads so that it can even be used a tubular string anchor having a finger collet design.

In applications with continuing flow through the anchor the actuator 40 can have a passage through it and the cap 56 replaced by an open tubular to location further away in the string 10. The inside diameter of the actuator 40 with a passage through it would then not need to be any smaller than the inside diameter formed by the fingers 38 in the set position of FIG. 2. The sleeve 24 continues to function as previously described.

The fingers 36 and 38 extend from opposed housing ends and are preferably integral to the collet heads 16 to create the flexible structure of support for the heads in a trapped finger design.

Those skilled in the art will appreciate that the present invention offers the use of a flexible finger collet assembly to latch into a stationary recess in a tubular string to find support for a downhole tool whether it is a plug as described or some other tool. The fingers are fabricated in a tapering position so that the collet heads are retracted for run in and the fingers assume a more parallel orientation to the surrounding tubular in the set position with the collet heads in the recess. This better enables the fingers 38 to tolerate tensile and compressive loads. The sleeve 24 can be used to bypass fingers 38 when the loading is compressive. Alternatively the actuator 40 can be made longer as shown in FIGS. 3 and 4 so that it provides buckling support to fingers 38 against the surrounding tubular when a compressive load goes through the fingers 38. As yet another option as shown in FIGS. 3 and 4 the longer actuator 40 can be combined with the sleeve 24 for enhanced protection of the fingers 38 in compressive loading situation. The contact between the collet heads 16 and the upper end 34 of the sleeve 24 can occur on initial extension of the collet heads 16 or can initially occur under loading, whether it is tensile on fingers 38 or compressive on sleeve 24.

The above description is illustrative of the preferred embodiment and many modifications may be made by those skilled in the art without departing from the invention whose scope is to be determined from the literal and equivalent scope of the claims below.

We claim:

1. An anchor for securing a tool to a recess adjacent a landing shoulder in a tubular string at a subterranean location comprising:

a housing comprising a plurality of fingers extending from opposed ends of collet heads that flexibly support said collet heads;

an actuator selectively movable with respect to said housing to selectively force said collet heads into the recess; and a landing sleeve supported by said housing to land on the landing shoulder, said landing sleeve transmitting stress from said housing to said collet heads when said collet heads are supported in the recess.

2. The anchor of claim 1, wherein:

said landing sleeve overlaps at least some of said fingers.

3. The anchor of claim 1, wherein:

said fingers taper inwardly from said ends to said collet heads before said actuator is moved.

4. The anchor of claim 3, wherein:

said fingers are in substantial alignment with an axis of said housing when said actuator moves said collet heads to said recess.

5. The anchor of claim 1, wherein:

movement of said actuator against said collet heads creates a potential energy force in said fingers, said potential energy force retracts said collet heads from the recess when said actuator is retracted to the original position of said collets of tapering inwardly from said ends toward said collet heads.

6. The anchor of claim 1, wherein:

said housing supports loads of at least 30,000 pounds with said collet heads supported in said recess.

7. An anchor for securing a tool to a recess adjacent a landing shoulder in a tubular string at a subterranean location comprising:

a housing comprising a plurality of fingers formed between an upper and lower ends thereof that flexibly support collet heads;

an actuator selectively movable with respect to said housing to selectively force said collet heads into the recess; and a landing sleeve supported by said housing to land on the landing shoulder, said landing sleeve transmitting stress from said housing to said collet heads when said collet heads are supported in the recess;

said landing sleeve overlaps at least some of said fingers;

said landing sleeve is located between said collet heads and said lower end.

8. The anchor of claim 7, wherein:

said landing sleeve has an upper end in initial contact with said collet heads when said collet heads are supported in the recess or when said housing is under stress with said collet heads supported in the recess.

9. The anchor of claim 8, wherein:

said fingers taper inwardly from said ends to said collet heads before said actuator is moved.

10. The anchor of claim 9, wherein:

said fingers are in substantial alignment with an axis of said housing when said actuator moves said collet heads to said recess.

11. The anchor of claim 10, wherein:

movement of said actuator against said collet heads creates a potential energy force in said fingers, said potential energy force retracts said collet heads from the recess when said actuator is retracted to the original position of said collets of tapering inwardly from said ends toward said collet heads.

12. The anchor of claim 11, wherein:

said housing supports loads of at least 30,000 pounds with said collet heads supported in said recess.

13. An anchor for securing a tool to a recess adjacent a landing shoulder in a tubular string at a subterranean location comprising:

a housing comprising a plurality of fingers formed between an upper and lower ends thereof that flexibly support collet heads;

an actuator selectively movable with respect to said housing to selectively force said collet heads into the recess; and a landing sleeve supported by said housing to land on the landing shoulder, said landing sleeve transmitting stress from said housing to said collet heads when said collet heads are supported in the recess;

said housing supports a seal to block a passage through the tubular.

14. An anchor assembly for securing a tool to a recess adjacent a landing shoulder in a tubular string at a subterranean location comprising:

a landing device comprising a stationary recess and a landing shoulder supported in the subterranean location as an inline part of a tubular string;

a housing within said tubular string and comprising a plurality of fingers extending from opposed ends of collet heads that flexibly support said collet heads, said collet heads selectively engageable with said recess upon radially outward movement away from an axis of said housing for support of said housing to said tubular string;

an actuator selectively movable with respect to said housing to selectively outwardly force and retain said collet heads in said recess:, said fingers taper inwardly from said ends to said collet heads before said actuator is moved and are moved radially outwardly to substantial alignment with said axis of said housing when said actuator moves said collet heads to said recess.

15. The assembly of claim 14, wherein:

said housing supports loads of at least 30,000 pounds with said collet heads supported in said recess.

16. An anchor assembly for securing a tool to a recess adjacent a landing shoulder in a tubular string at a subterranean location comprising:

a landing device comprising a stationary recess and a landing shoulder supported in the subterranean location as an inline part of a tubular string;

a housing comprising a plurality of fingers extending from opposed ends of collet heads that flexibly support said collet heads, said collet heads selectively engageable with said recess;

an actuator selectively movable with respect to said housing to selectively force and retain said collet heads in said recess;

a landing sleeve supported by said housing to land on the landing shoulder, said landing sleeve transmitting stress from said housing to said collet heads when said collet heads are supported in the recess.

17. The assembly of claim 16, wherein:

said landing sleeve overlaps at least some of said fingers.

18. The anchor of claim 16, wherein:

said fingers taper inwardly from said ends to said collet heads before said actuator is moved;

said fingers are in substantial alignment with an axis of said housing when said actuator moves said collet heads to said recess.

19. An anchor assembly for securing a tool to a recess adjacent a landing shoulder in a tubular string at a subterranean location comprising:

a landing device comprising a stationary recess and a landing shoulder supported in the subterranean location as an inline part of a tubular string;

a housing comprising a plurality of fingers formed between an upper and lower ends thereof that flexibly support collet heads, said collet heads selectively engageable with said recess;

an actuator selectively movable with respect to said housing to selectively force and retain said collet heads in said recess;

a landing sleeve supported by said housing to land on the landing shoulder, said landing sleeve transmitting stress from said housing to said collet heads when said collet heads are supported in the recess;

said landing sleeve overlaps at least some of said fingers;

said landing sleeve is located between said collet heads and said lower end.

20. The anchor of claim 19, wherein:

said landing sleeve has an upper end in contact with said collet heads when said collet heads are supported in the recess or when said housing is under stress with said collet heads supported in the recess.

21. An anchor assembly for securing a tool to a recess adjacent a landing shoulder in a tubular string at a subterranean location comprising:

a landing device comprising a stationary recess and a landing shoulder supported in the subterranean location as an inline part of a tubular string;

a housing comprising a plurality of fingers extending from opposed ends of collet heads that flexibly support said collet heads, said collet heads selectively engageable with said recess;

an actuator selectively movable with respect to said housing to selectively force and retain said collet heads in said recess;

said fingers taper inwardly from said ends to said collet heads before said actuator is moved;

said fingers are in substantial alignment with an axis of said housing when said actuator moves said collet heads to said recess.

22. An anchor assembly for securing a tool to a recess adjacent a landing shoulder in a tubular string at a subterranean location comprising:

a landing device comprising a stationary recess and a landing shoulder supported in the subterranean location as an inline part of a tubular string;

a housing comprising a plurality of fingers extending from opposed ends of collet heads that flexibly support said collet heads, said collet heads selectively engageable with said recess;

an actuator selectively movable with respect to said housing to selectively force and retain said collet heads in said recess;

said anchor is configured to axially advance between said collet heads, as said collet heads are extended into said recess, and said lower end of said housing, to lend a guiding support to said fingers between said lower end of said housing and said collet heads when said housing is loaded in compression.

23. The anchor of claim 22, wherein:

a landing sleeve supported by said housing to land on the landing shoulder, said landing sleeve transmitting stress from said housing to said collet heads when said collet heads are supported in the recess.

* * * * *